United States Patent [19]

Jumel et al.

[11] Patent Number: 4,880,139

[45] Date of Patent: Nov. 14, 1989

[54] CASING WITH INVISIBLE HINGE

[75] Inventors: Bernard Jumel; Charles Pileur, both of Neuilly-sur-Seine, France

[73] Assignee: Yves Saint Laurent Parfumes, France

[21] Appl. No.: 151,990

[22] Filed: Feb. 3, 1988

[30] Foreign Application Priority Data

Feb. 4, 1987 [FR] France ..... 87 01352

[51] Int. Cl.[4] ..... B65D 43/14

[52] U.S. Cl. ..... 220/337; 206/581

[58] Field of Search ..... 220/337, 338; 206/581

[56] References Cited

U.S. PATENT DOCUMENTS

| | | | |
|---|---|---|---|
| 2,370,928 | 3/1945 | Baldanza | 220/31 |
| 2,509,355 | 5/1950 | Kampa | 220/31 |
| 2,661,114 | 12/1953 | Barnett | 220/4 |
| 3,333,726 | 8/1967 | Belanger | 220/337 |
| 3,342,190 | 9/1967 | Hultgren | 132/83 |
| 3,394,835 | 7/1968 | Peterson | 220/337 |
| 3,612,335 | 10/1971 | Schurman | 220/338 |
| 3,984,028 | 10/1976 | Zinnbauer | 220/337 |
| 4,005,800 | 2/1977 | Schurman | 220/337 |
| 4,211,337 | 7/1980 | Weavers et al. | 220/337 |
| 4,448,327 | 5/1984 | Gahm | 220/337 |
| 4,527,755 | 7/1985 | Rood et al. | 220/337 |
| 4,623,071 | 11/1986 | Malcolm | 220/337 |
| 4,673,083 | 6/1987 | Schuett | 220/337 |

FOREIGN PATENT DOCUMENTS

| | | |
|---|---|---|
| 2338671 | 8/1977 | France . |
| 2458243 | 1/1981 | France . |
| 1148240 | 4/1969 | United Kingdom . |

*Primary Examiner*—Joseph Man-Fu Moy

*Attorney, Agent, or Firm*—Steinberg & Raskin

[57] ABSTRACT

The present invention relates to a casing with invisible hinge, wherein the receptacles respectively of the two hinge axes are made in one of the side walls of an inner element and emerge outwardly to permit the introduction of the axes of the hinge respectively into the two receptacles during the fitting of the two half-casings forming the casing. An outer element fits on the inner element to completely close both receptacles at one of its corresponding side walls, thus rendering the hinge invisible from the outside.

12 Claims, 6 Drawing Sheets

CASING WITH INVISIBLE HINGE

BACKGROUND OF THE INVENTION

The present invention is concerned with a casing, in particular for cosmetics such as powders, paints, and the like, comprising two half-casings forming respectively a bottom and a cover pivotally hinged on each other, in which the hinge-forming elements are invisible once the casing is assembled.

SUMMARY OF THE INVENTION

The casing according to the invention is of the type comprising two half-casings linked by a hinge enabling them to pivot about an axis with respect to each other, the hinge including two pivots carried by one of the half-casings and two receptacles made on the other half-casing and in which the two pivots can swivel, the half-casing which includes both receptacles being constituted by two elements, one outer and one inner element, which can be fitted, and is characterized in that both receptacles are made in one of the said side walls of the inner element and open outwardly to permit the introduction of the pivots respectively in the two receptacles when the two half-casing are fitted together, and in that the outer element, when fitted on the inner element, completely closes both receptacles at one of its corresponding side walls which maintains the pivots in their respective receptacles, whereby the hinge is rendered invisible from the outside.

According to another feature of the invention, the side wall of the inner element presents a hinge stirrup-like configuration comprising two parallel, spaced apart side arms linked by a transverse part provided with a substantially cylindrical longitudinal recess concave in shape, the two receptacles of the pivots being respectively made in the arms of the stirrup forming them as a clevis and the pivots are attached to both ends of a rib including an approximately straight longitudinal part solid with the other associated half-casing, extending substantially perpendicularly from the bottom of this half-casing near a side wall of this one, and a part in form of an arc of a cylinder, extending the straight part to the outside of the half-casing, pivoting in the longitudinal recess of the transverse part so as to continually conceal the hinge during the opening of the casing.

Other purposes, features and advantages of the invention will appear more clearly in the light of the following explanatory description with reference to the appended diagrammatic drawings given only by way of example illustrating an embodiment of the invention, and in which.

DETAILED DESCRIPTION OF PREFERRED EMBODIMENT

Figure 1:
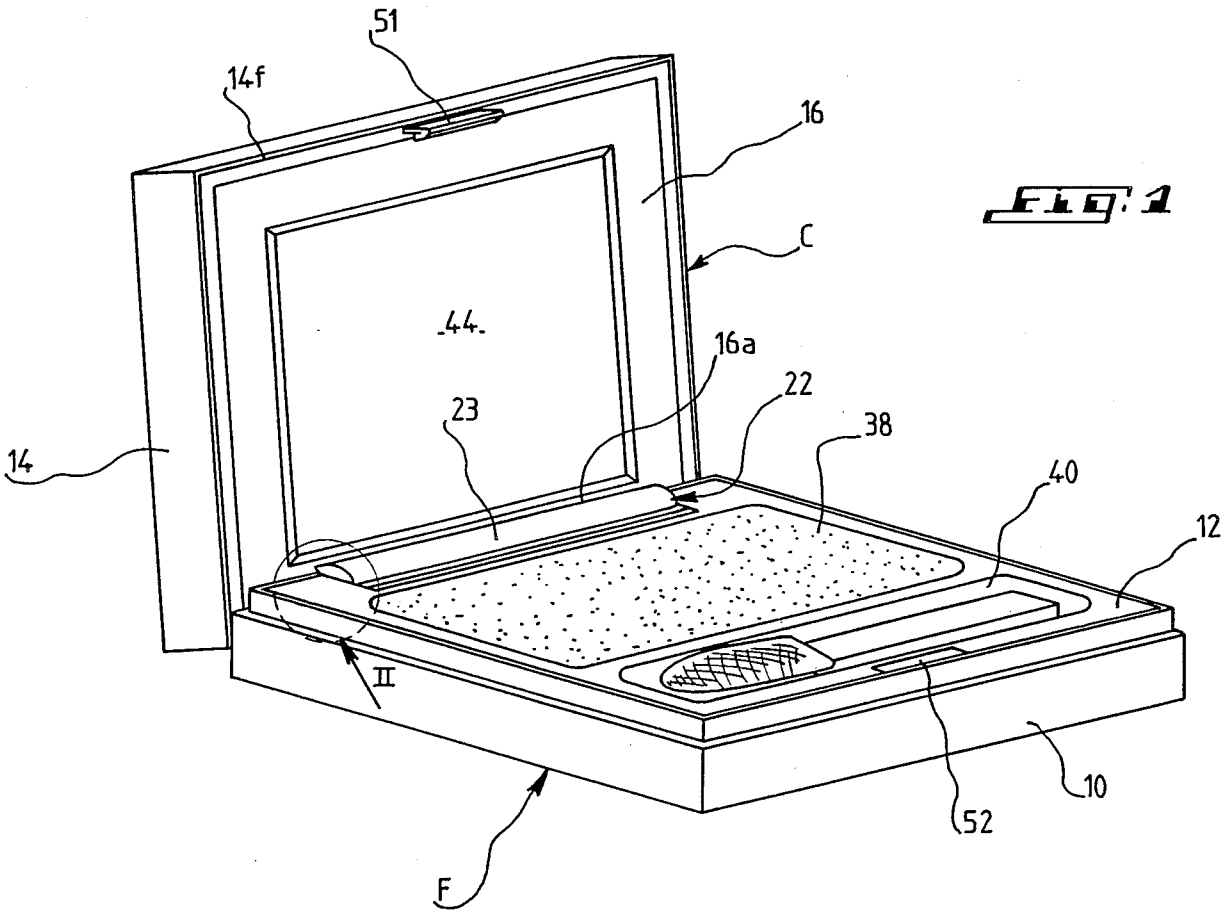
FIG. 1 is a general elevational view of a casing according to the invention constituted by two half-casings of which one at least forms the bottom and comprises an inner element and an outer element, both elements being fitable.
Figure 2:
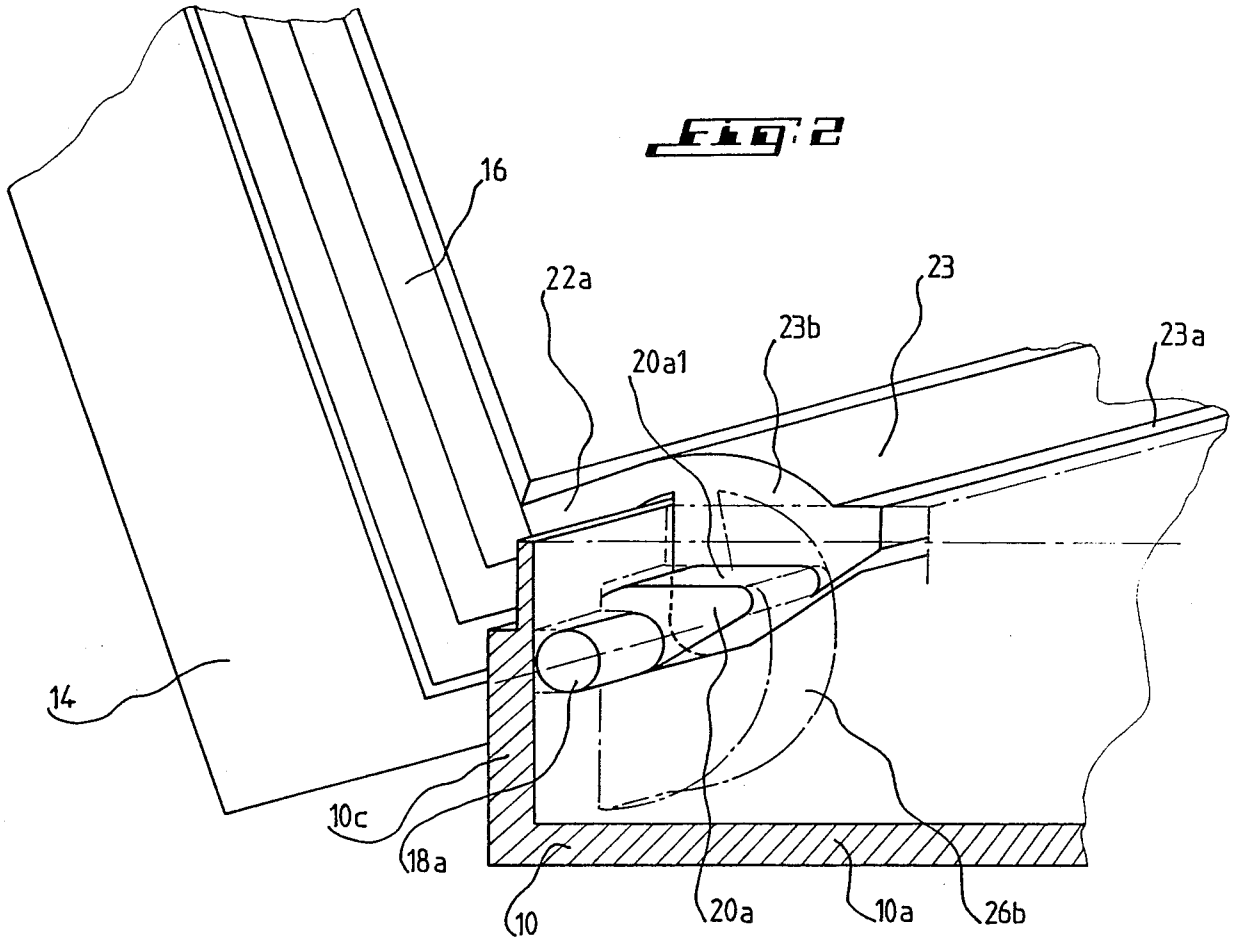
FIG. 2 is a stripping view of the encircled part at II of FIG. 1, the chain-dotted lines representing the inner element of the bottom.
Figure 4:
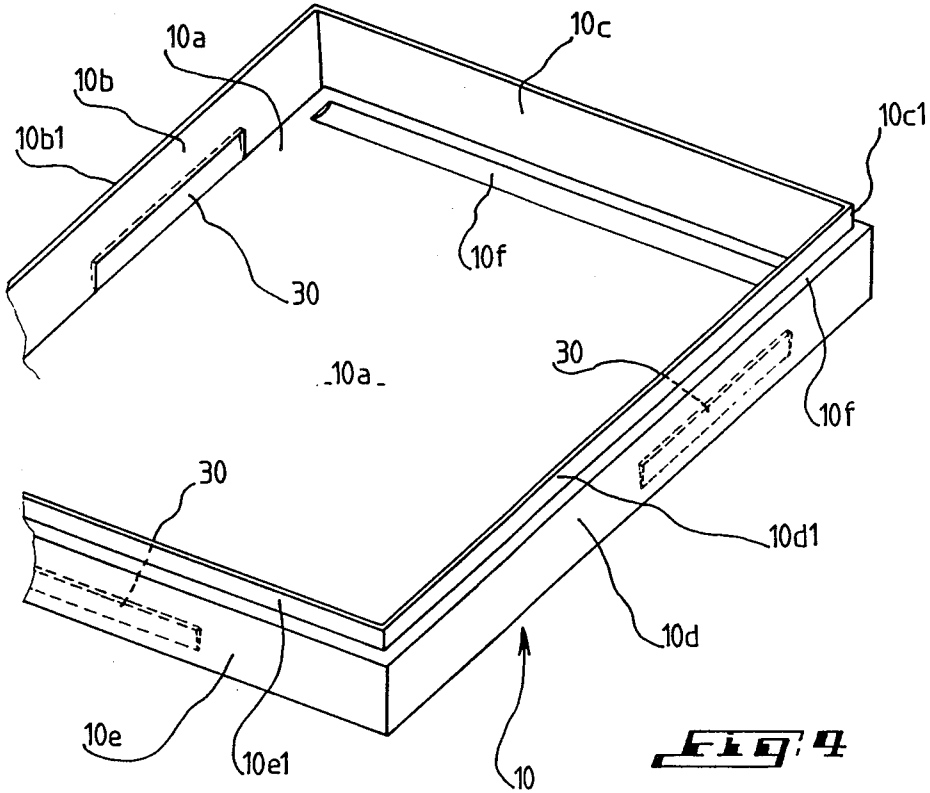
FIG. 4 is a perspective view along arrow IV of FIG. 3.
Figure 3:
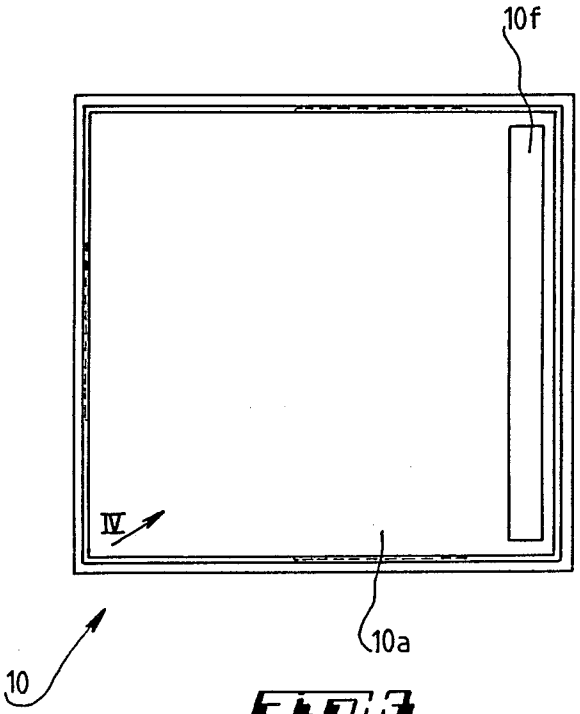
FIG. 3 is a top view of the outer element of the bottom.
Figure 6:
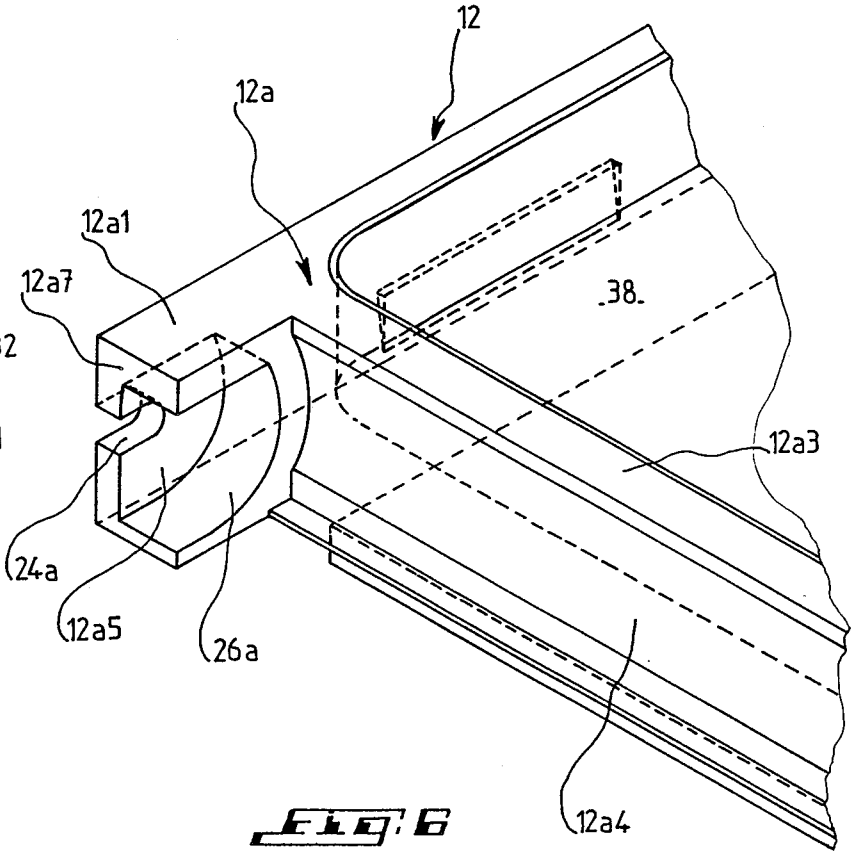
FIG. 6 is a partial perspective view along arrow VI of FIG. 5.
Figure 5:
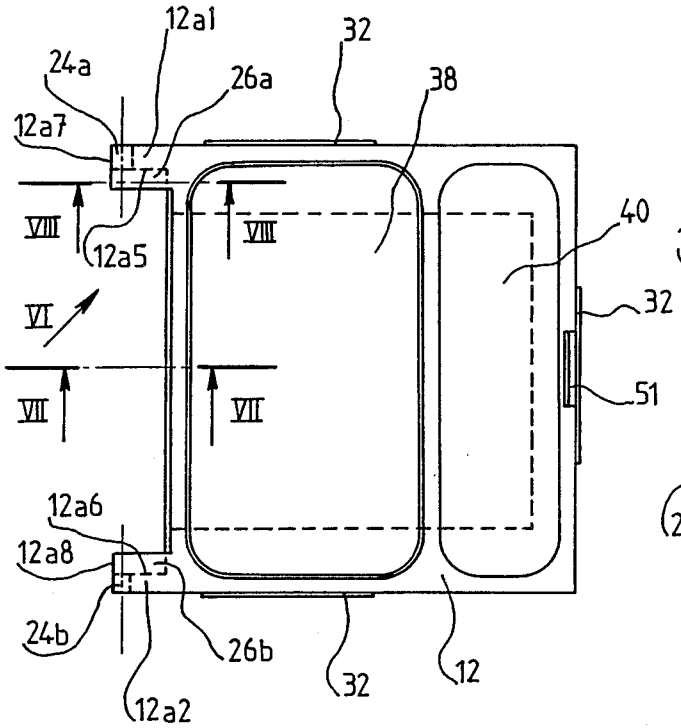
FIG. 5 is a top view of the inner element of the bottom.
Figure 8:
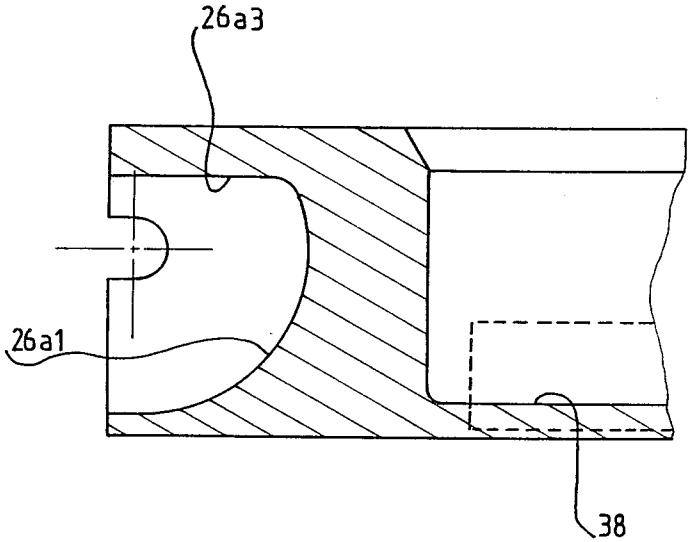
FIG. 8 is a cross-sectional view along line VIII—VIII of FIG. 5.
Figure 7:
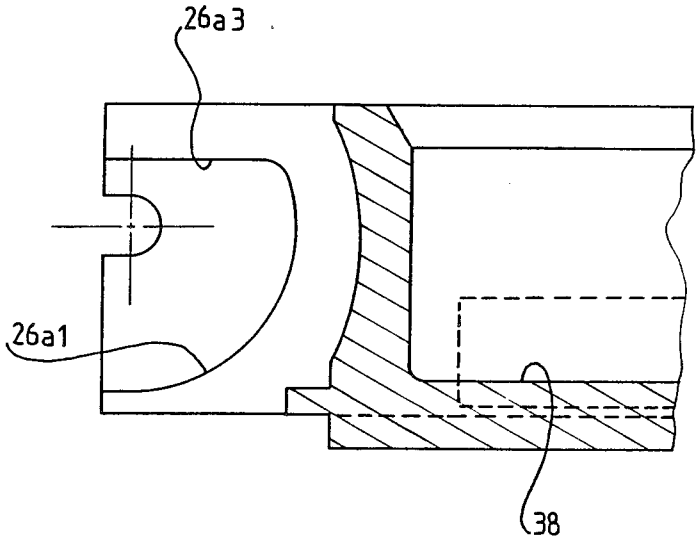
FIG. 7 is a cross-sectional view along line VII—VII of FIG. 5.
Figure 12:
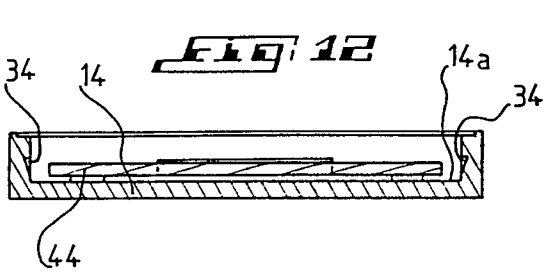
FIG. 12 is a cross-sectional view along line XII—XII of FIG. 11.
Figure 11:
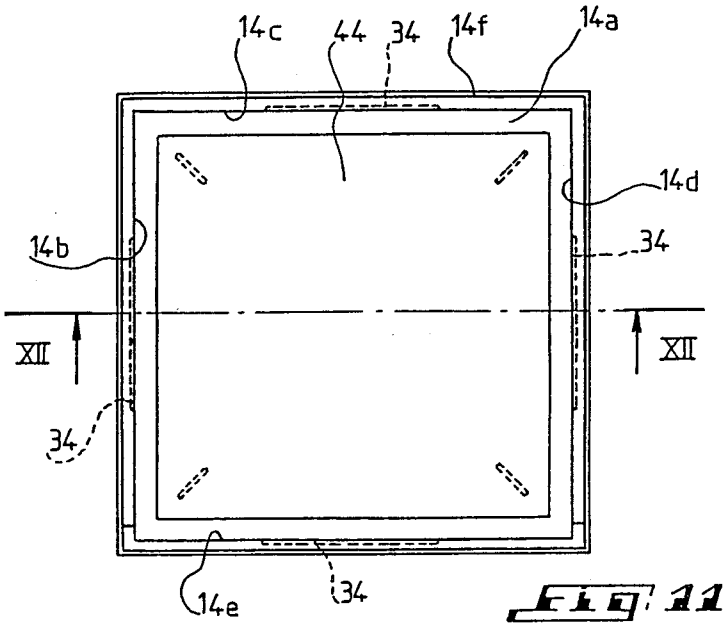
FIG. 11 is a bottom view of the outer element of the cover fitable on the inner element.
Figure 10:
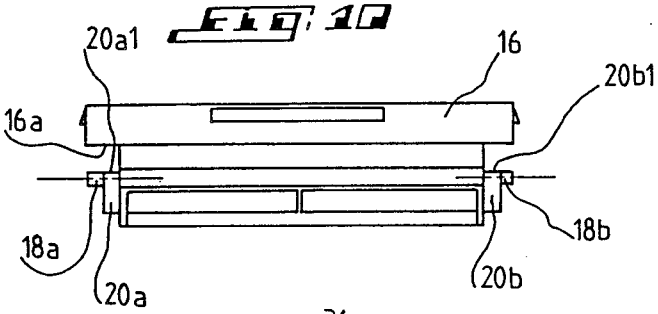
FIG. 10 is a view along arrow X of FIG. 9.
Figure 9:
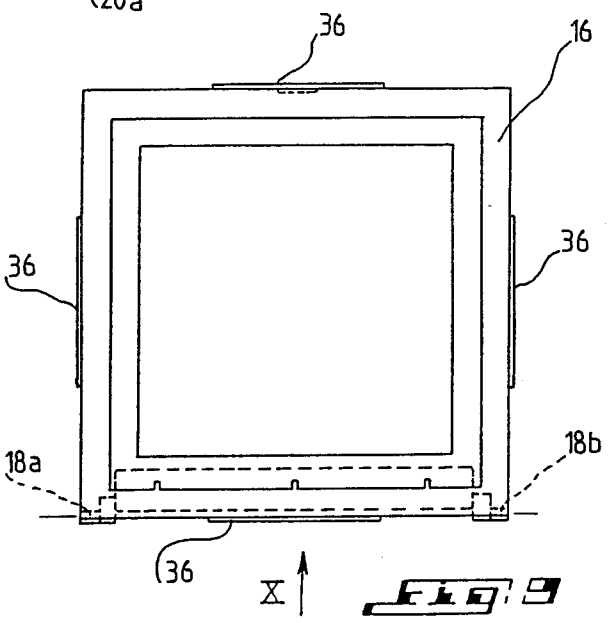
FIG. 9 is a top view of the inner element of the other cover forming half-casing.

The different elements forming the casing according to the invention are identified by the same reference signs in the different Figures.

In the embodiment shown, the casing is generally quadrangular in shape and consists of two half-casings forming respectively the bottom F and the cover C. The bottom F comprises an outer element 10 with a square bottom 10*a* and side walls 10*b*–10*e* perpendicular to the bottom 10*a* and an inner element 12 fitable into the outer element 10 and which may comprise for example two cups 38 and 40 for receiving different paints and/or paint applications tools. The cover C consists also of an outer element 14 with a square bottom 14*a* and side walls 14*b*–14*e* perpendicular to the bottom 14*a* on which is fixed for example by bonding a square mirror, and of an inner element 16 fitable into outer element 14 and in form of a frame applied against mirror 44 along the periphery thereof.

The cover C pivots with respect to the bottom F about an axis of rotation through a hinge comprising two coaxial pivots 18*a*, 18*b* having a circular cross-section and fixed respectively in an opposed manner on the two ends of a rib 22 including an approximately straight part 22*a* solid with the outer face 16*a* of one of the sides of the frame of the inner element 16 and extending substantially perpendicularly to this face while being substantially parallel to the side wall 14*e* of the outer element 14 when the latter is fitted on the inner element 16. The straight part 22*a* of the rib 22 is extended by a part in form of an arc of a cylinder 23 limited by a short 23*a* and the ends of which are limited respectively by two side walls 23*b* extending substantially vertically below the concavity of the part in the form of an arc of a cylinder 23. The two side walls 23*b* carry respectively the two pivots 18*a*, 18*b* at their lower parts. The hinge further comprises two suitably shaped receptacles 24*a*, 24*b* to receive respectively the pivots 18*a*, 18*b* and made in the side wall 12*a* of the inner element 12 of the bottom forming half-casing. More precisely, the side wall 12*a* presents a hinge stirrup configuration consisting of two parallel, spaced apart side arms 12*a*1, 12*a*2 linked by a transverse part 12*a*3 defining a side wall of the cup 38 and provided with a longitudinal concave recess 12*a*4 substantially cylindrical in shape. The substantially U-shaped receptacles 24*a*, 24*b* the width and depth of which are substantially equal to the diameter of the pivots 18*a*, 18*b* are made respectively in the arms 12*a*1, 12*a*2 of the stirrup so as to each emerge outwardly into the front or end wall 12*a*7, 12*a*8 of the arm 12*a*1, 12*a*2. Both receptacles 24*a*, 24*b* are located at a same distance of the plane passing on the upper edges of the cups 38 and 40 and each form clevis-shaped arms 12*a*1, 12*a*2.

The side arms 12a1, 12a2 of the stirrup are spaced apart by a distance slightly greater than the length of the part in form of an arc of a cylinder 23 of the rib 22.

The two side walls 23b carry the two pivots 18a, 18b through respectively two cam-shaped members 20a, 20b each one of which is integral with the lower part of the associated side wall 23b and delimiting the pivoting amplitude of the cover C with respect to the bottom F to adjust the angle of opening, for example of 110° C., of the cover C. The cam-forming members 20a, 20b are received respectively into two appropriately shaped receptacles 26a, 26b formed respectively in the inner faces in front of each other of the two side arms 12a1, 12a2 of the hinge stirrup. Each receptacle 26a, 26b is defined by a recessed part emerging at the inner side of the corresponding arm 12a1, 12a2 of the stirrup and at the front wall 12a7, 12a8 of this arm 12a1, 12a2, the recessed part having a bottom wall 26a1 concave in shape, the cross-section of which is in the form of an arc of a circle coaxial with the coating or hinge axis of both half-casings. Each recessed part 26a, 26b, delimited by a side wall 12a5, 12a6 of the arm 12a1, 12a2 and including the associated receptacle 24a, 24b of the pivots 18a, 18b, includes a plane upper inner wall 26a3 fitting together with the concave part 26a1 and parallel to the plane passing on the upper edges of the cups 38, 40. The upper walls 26a3 co-operate respectively with upper faces 20a1, 20b1 of the cam-shaped members 20a, 20b to limit the pivoting amplitude of the cover C with respect to the bottom F.

The part in the form of an arc of a cylinder 23 of the rib 22 has an axis coaxial with the axis of the pivots 18a, 18b and pivots between the arms 12a1, 12a2 of the stirrup and inside the recess 12a4, the depth of which is substantially equal to the radius of the arc of a cylinder 23.

The inner element 12 of the bottom F includes on its side walls, other than the wall 12a, outer ribs 32 co-operating by cogging with corresponding slots 30 made respectively in the walls 10b, 10d and 10e of the outer element 10 to permit the fixing of the outer element 10 on the inner element 12. It is to be noted that the bottom 10a of the outer element 10 includes a concave longitudinal recess 10f substantially cylindrical in shape disposed in a substantially parallel manner with respect to the side wall 10c near the latter to permit the free passing of the shoulder 23a during the opening or the closing of the casing.

Similarly, the inner element 16 of the cover C includes on its side walls ribs 36 co-operating by cogging with slots 34 made in the walls 14b–14e of the outer element 14 to permit the fixing of the outer element 14 on the inner element 16 of the cover C.

The assembly of the casing according to the invention proceeds first by fitting the outer element 14 of the cover C on the inner element 16, the frame of which permits the housing of mirror 44, sandwiched between the inner element 16 and the outer element 14. When the inner element 16 is fitted inside the outer element 14, the rib 22 protrudes over the plane passing on the edges of the side walls 14b–14e of the outer element 14 by a distance substantially equal to the height of the side walls of the outer element 10 of the bottom F. Thereafter, the pivot and cam assemblies 18a, 20a and 18b, 20b are introduced into their respective receptacles 24a, 26a and 24b, 26b at their emerging lateral apertures, whereby the part in the form of an arc of a cylinder 23 of the rib 22 enters the longitudinal recess 12a4.

Then the outer element 10 of the bottom F is fitted by cogging on the inner element 12 with the aid of the ribs 32 co-operating with the corresponding slots 30. Thus, the side wall 10c of the outer element 10 totally closes the receptacles 24a, 24b and 26a, 26b emerging into the front or end wall of the arms 12a1 and 12a2 and the space delimited between the arms 12a1 and 12a2, thus maintaining the pivots 18a, 18b in their respective receptacles while concealing from the outside the elements forming the hinge.

During the opening of the casing, the assemblies formed by the pivots 18a, 18b and the associated cam-shaped members 20a, 20b pivot respectively in the receptacles 24a, 24b and 26a, 26b about the axis delimited by the pivots 18a, 18b until the cams 20a and 20b abut at their respective upper faces 20a1 and 20b1 against the upper walls 26a3 of the corresponding receptacles 26a and 26b, which determines the angle of opening of the cover C with respect to the bottom F. The rib 22 itself swivels about the pivots 10a, 18b, the part in the form of an arc of a cylinder 23 of the rib pivoting inside the longitudinal recess 12a4 and the cross-sectional value of the arc of a circle thereof being such that it continually conceals the elements of the hinge.

In the closed position, the cover C and the bottom F are maintained in such a manner that they are applied on each other with the aid of a fastener of classical type comprising a tongue 51 provided on a side of the frame of the inner element 16 opposite the side carrying the rib 22 and resiliently cogging into a corresponding aperture 52 made in the upper face of the inner element 12 opposite the hinge.

Each one of the side walls 10b–10e of the outer element 10 ends outwardly at a portion of upper wall 10b1-10e1 linked to the corresponding wall 10b–10e through a peripheral flat step 10f in such a manner that the length of the parts of upper wall is smaller than that of the walls 10b–10e. This structure enables the upper walls, during the closing of the casing, to be slightly embedded at their edges in a corresponding peripheral recess 14f made in the outer element 14 near its side walls 14b–14e while leaving a peripheral space between the edges of these walls and the step 10f, in the closed position of the casing, which is sufficient to permit the opening of the casing.

The inner element 16, the rib 22, the cam-shaped members 20a, 20b and the pivots 18a, 18b are made in one piece and preferably of a moulded plastics material. Similarly, the inner element 12 with its arms 12a1, 12a2 is made in one piece of a moulded plastics material. Finally, the outer elements 10 and 14 are made for example of metal.

What is claimed is:

1. Casing, in particular for cosmetics, comprising two half-casings linked by a hinge enabling said half-casings to pivot about an axis with respect to each other, said hinge including two pivots carried by one of said half-casings and two receptacles on the other half-casing and in which both pivots can swivel, the half-casing which includes the two receptacles being constituted by two elements, one outer and one inner element, which can be fitted, wherein both receptacles are located in one of the side walls of the inner element and open outwardly to permit the free introduction of the pivots respectively into the two receptacles when the two half-casings are fitted together, the outer element when fitted on the inner element completely closing both receptacles at one of its corresponding side walls which maintains the pivots in their respective receptacles, whereby the hinge is rendered invisible from the outside, and wherein said inner element includes means for totally covering said hinge from outside, even when said one half-casing is opened, whereby said hinge is rendered invisible from the outside, even when said one half-casing is opened.

2. Casing according to claim 1, wherein said side wall of the inner element presents a hinged stirrup-like configuration comprising two parallel, spaced apart side arms linked by a transverse part and is provided with a substantially cylindrical longitudinal recess concave in shape, the two receptacles of the pivots being respectively made in the arms of the stirrup, forming them as a clevis, the pivots being attached to the two ends of the rib including an approximately straight longitudinal part solid with the half-casing, extending substantially perpendicularly from the bottom of the half-casing near a side wall thereof and a part in the form of an arc of a cylinder extending the straight part to the outside of the half-casing pivoting in the longitudinal recess of the transverse part so as to continually conceal the hinge during the opening of the casing.

3. Casing according to claim 2, further comprising two cam-shaped members respectively associated with the two pivots and lodged inside appropriately shaped receptacles emerging outwardly, and made in the arms of the stirrup, each receptacle being delimited by an upper inner wall against which abuts the corresponding cam-forming member at the end of the opening of the casing, thus limiting the movement of relative pivoting of both half casings.

4. Casing according to claim 3, wherein the receptacles of the cam-forming members are made respectively in the inner faces of the arms of the hinge stirrup.

5. Casing according to claim 1, wherein both pivots have a circular cross-section and their respective receptacles have a width and a depth substantially equal to the diameter of the pivots.

6. Casing according to claim 3, wherein the pivots and the associated cam-forming members are solid respectively with two parallel side walls extending beneath the concavity of the part in form of an arc of a cylinder of the rib.

7. Casing according to claim 2, wherein the half casing carrying the two pivots consists of two fitable elements, one outer element and one inner element, and the rib is solid with the inner element which is in form of a frame.

8. Casing according to claim 7, wherein the inner element of the half casing, the rib, the pivots and the cam-shaped members are made in one piece of a moulded plastics material.

9. Casing according to claim 7, wherein the outer and inner elements respectively of the two half-casings fit with each other by cogging.

10. Casing according to claim 7, wherein the inner element of the half-casing carrying the pivots performs fixing of a mirror on the bottom of said half-casing.

11. Casing in particular for cosmetics, comprising two half-casings linked by a hinge enabling said half-casings to pivot about an axis with respect to each other, the hinge including two pivots carried by one of the half-casings and two receptacles on the other half-casing and in which both pivots can swivel, the half-casing which includes the two receptacles being constituted by two elements, one outer and one inner element, which can be fitted, wherein both receptacles are made in two spaced apart side arms respectively of one of the side walls of the inner element, open outwardly and are each clevis-shaped to allow the free introduction of the pivots respectively into the two receptacles when the two half-casings are fitted together, the outer element, when fitted on the inner element, completely closing both receptacles at one of its corresponding side walls which maintains the pivots in their respective receptacles, whereby the hinge is rendered invisible from the outside, and wherein said arms each comprise means for completely covering/enclosing said hinge from outside, even when said one half-casing is opened, whereby the hinge is rendered invisible from the outside, even when said one half-casing is opened.

12. Casing, in particular for cosmetics, comprising two half-casings linked by a hinge enabling said half casings to pivot about an axis with respect to each other, the hinge including two pivots carried by one of the half-casings and two receptacles on the other half-casing and in which both pivots can swivel, the half-casing which includes the two receptacles being constituted by two elements, one outer and one inner element, which can be fitted, wherein both receptacles are made in one of the side walls of the inner element and opens outwardly and two cam-shaped members for limiting the movement of relative pivoting of both half-casings are associated with the two pivots, respectively, and lodged inside appropriately shaped receptacles made in said side wall of the inner element and opening outwardly, in order to allow the free introduction of the pivots and the cam-shaped members into their respective receptacles when the two half-casings are fitted together and wherein the outer element, when fitted on the inner element, completely closes said receptacles at one end of its corresponding side walls which maintains the pivots and the cam-shaped members in their respective receptacles, whereby the hinge is rendered invisible from the outside.

* * * * *

UNITED STATES PATENT AND TRADEMARK OFFICE

CERTIFICATE OF CORRECTION

PATENT NO. : 4,880,139

DATED : November 14, 1989

INVENTOR(S) : Bernard Jumel, et al.

It is certified that error appears in the above-identified patent and that said Letters Patent is hereby corrected as shown below:

On the title page:

Item [73] Assignee: should read --Yves Saint Laurent Parfums, France--.

Signed and Sealed this

Seventh Day of January, 1992

*Attest:*

HARRY F. MANBECK, JR.

*Attesting Officer*

*Commissioner of Patents and Trademarks*